United States Patent [19]

Turner

[11] 4,285,522

[45] Aug. 25, 1981

[54] PATTERN GAME

[76] Inventor: Dale E. Turner, 5313 Halison St., Torrance, Calif. 90503

[21] Appl. No.: 117,825

[22] Filed: Feb. 4, 1980

[51] Int. Cl.[3] ..... A63F 9/20

[52] U.S. Cl. ..... 273/293; 273/271; 273/DIG. 27

[58] Field of Search ..... 273/271, 292, 293, 294, 273/295, DIG. 27

[56] References Cited

U.S. PATENT DOCUMENTS

| | | | |
|---|---|---|---|
| 3,330,053 | 7/1967 | Hendrix | 273/292 X |
| 3,845,574 | 11/1974 | Majewski | 273/293 X |

FOREIGN PATENT DOCUMENTS

| | | | |
|---|---|---|---|
| 163103 | 5/1921 | United Kingdom | 273/293 |

*Primary Examiner*—Anton O. Oechsle
*Attorney, Agent, or Firm*—Singer & Singer

[57] ABSTRACT

Two sets of rectangular shaped tiles in the form of dominoes are provided. Each set of tiles are divided in half to form perfect squares. Each square of the first set are provided with separate identifiable indicia such as color or touch. One square of each tile of the second set of tiles contain a third indicia different than the first two squares on the first set of tiles. The second square on each of the second set of tiles contain the same indicia as the first square on the first set of tiles. The tiles are placed on a substantially flat surface alternately between the first set and the second set with the object being the first to create a pattern of four or more touching similar squares on either a rank, a file or a diagonal.

9 Claims, 16 Drawing Figures

Fig. 1.
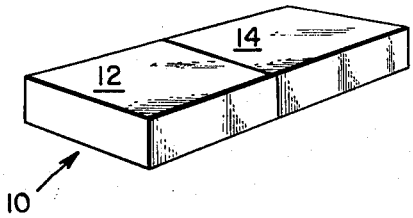
Fig. 2.
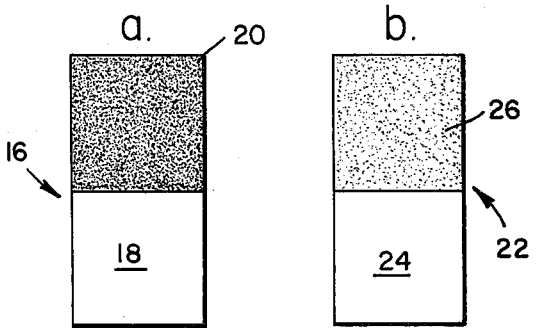
Fig. 3.
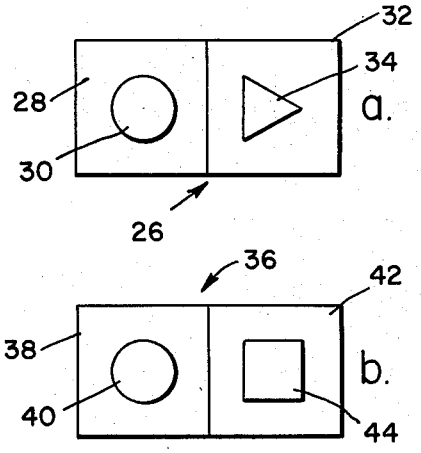
Fig. 4.
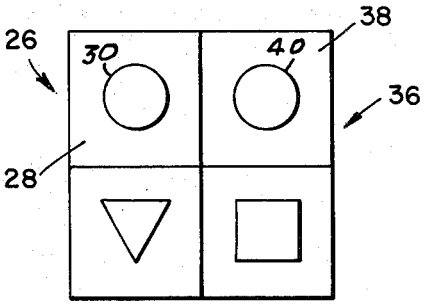
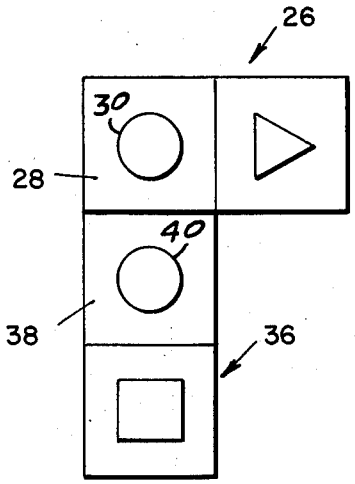
Fig. 5.
Fig. 6.
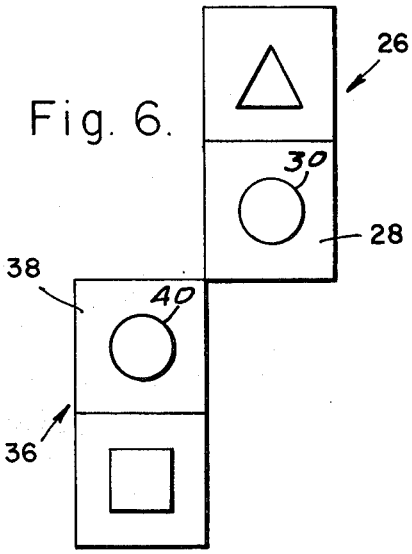

Fig. 8.
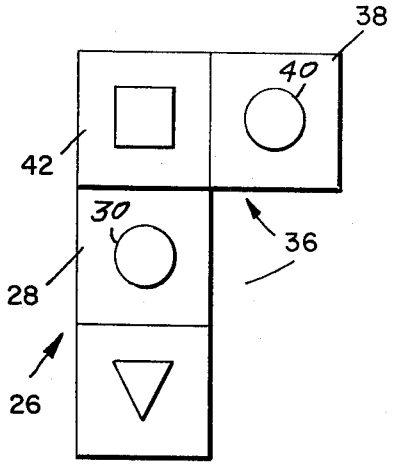
Fig. 7.
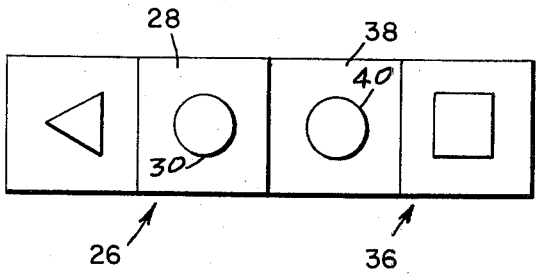
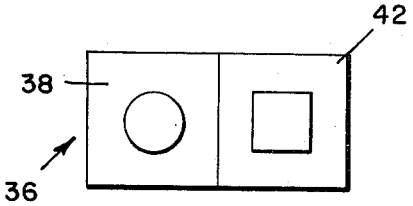
Fig. 9.
Fig. 10.
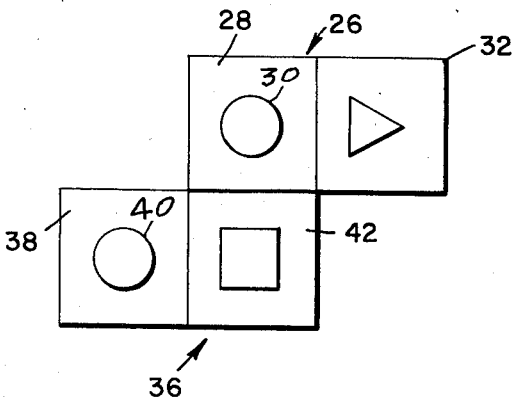
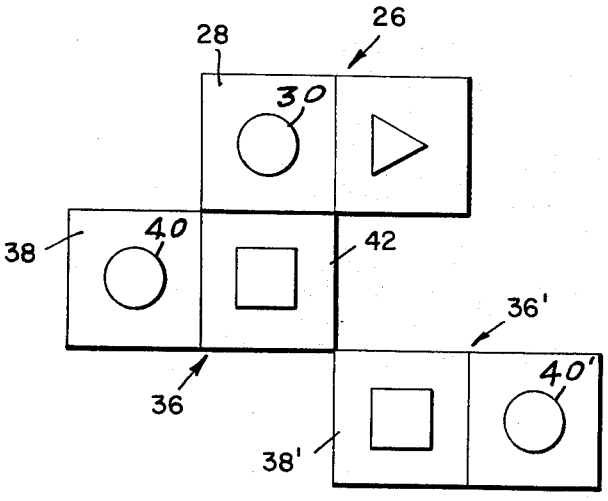
Fig. 11.

Fig. 12.
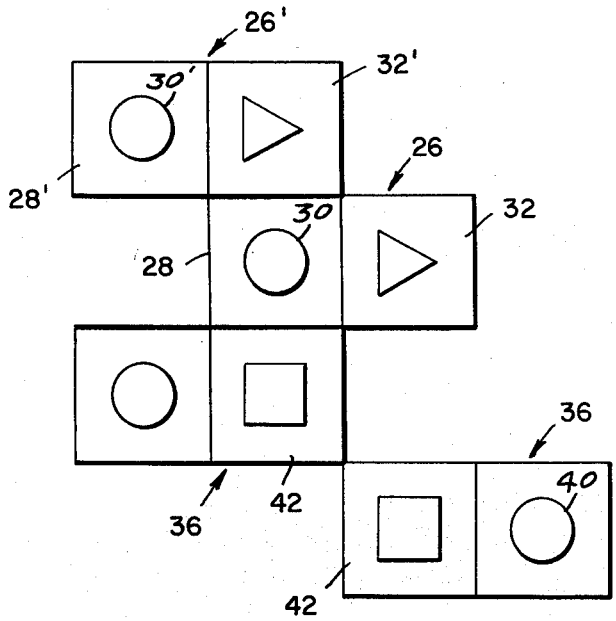
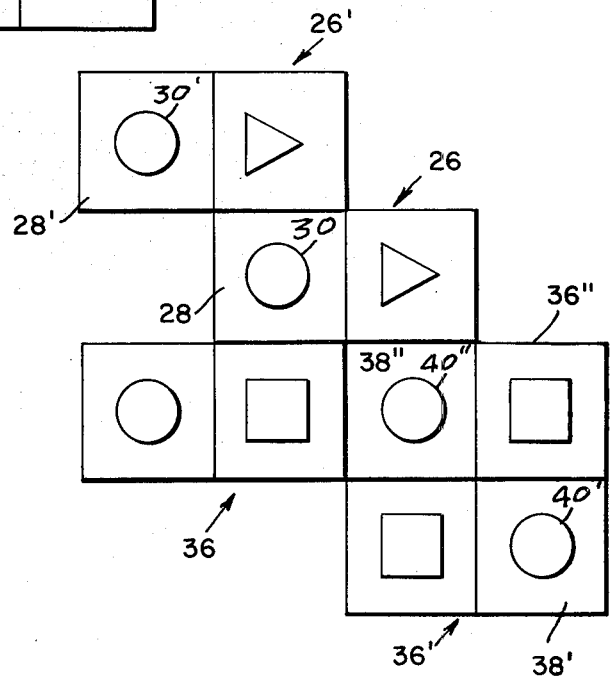
Fig. 13.
Fig. 14.
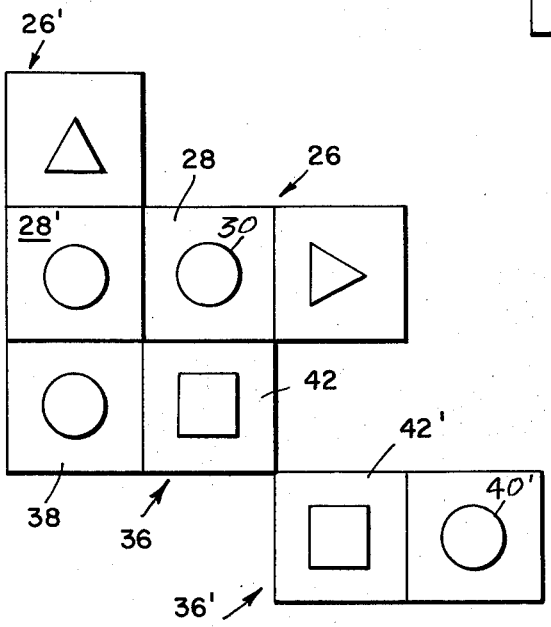

PATTERN GAME

This invention relates to a game capable of being played by two or more persons with the winner being the first to establish a pattern consisting of four or more similar objects touching to form a file, a rank or a diagonal.

The basic game element is a three-dimensional rectangle divided in half so that each rectangle forms two squares. The basic element resembles a domino that may be of any size.

The game comprises a first set of rectangles, each divided in half to form identical squares, and a second set of rectangles, each divided in half to form identical squares.

The first and second square on said first set of rectangles are separately identifiable from each other and similarly the first and second square on said second set of rectangles are separately identifiable from each other.

In the preferred embodiment the first and second square on each of the rectangles comprising the first set are visually separated from each other by having the first square visually distinct from the second square on each of the tiles comprising the first set.

The rectangles comprising the second set are also visibly separated from each other by having the first square of each of the rectangles comprising the second set containing still a third visibly distinct color. The second square on each of the rectangles comprising the second set contains the same color selected for the first square of the rectangles comprising the first set.

In other words, there are a total of three distinct colors used on all of the tiles comprising the first and second set. In addition, the first square of all the tiles comprising the first set contain the same color as all of the first squares on the second set of rectangles.

The game is played by first placing a tile from the first set on a substantially flat plane. A tile from the second set is then located in a touching relationship with any of the previously placed tiles on the flat plane. A tile may be placed in a touching relationship along the width, length or any corner in an attempt to have at least four color coded squares in a row either vertically, horizontally or diagonally.

Both sets of tiles are the same and in the preferred game plan it is envisioned that approximately 20 or 25 tiles per player comprising a set will be used. Since both sets of tile have one square containing the same color as that of the opponent, it becomes obvious that both offensive and defensive strategy must be planned in order to secure a winning pattern.

While the game has been described in connection with visibly distinct squares as by utilizing a total of three distinct colors, it is also envisioned that three physical indicia symbols may be used on the squares in lieu of three different paint schemes previously described.

For example, it is possible to use a raised disc, a raised triangle, and a raised square as the identifiable indicia on each of the squares, thereby enabling sightless people to play the game and identify the tiles by feel as opposed to identifying the tiles by sight.

Further objects and advantages of the present invention will be described as the description progresses and reference is now made to the accompanying drawings wherein:

FIG. 1 is a perspective drawing illustrating a rectangular tile in the form of a domino containing substantially equal squares;

FIG. 2 illustrates a pair of tiles containing separately identifiable squares by visible identification only;

FIG. 3 illustrates a pair of tiles containing separately identifiable squares both by feel and visual;

FIG. 4 illustrates two tiles abutting along two long edges;

FIG. 5 illustrates two tiles abutting along a long and a short edge;

FIG. 6 illustrates two tiles touching on a corner;

FIG. 7 illustrates two tiles abutting along a short edge;

FIG. 8 illustrates another embodiment of two tiles touching along a short edge and a long edge;

FIGS. 9, 10, 11, 12 and 13 illustrate a game won by using common indicia on both sets of tile; and FIG. 14 illustrates a variation on the game.

Referring now to FIG. 1, there is shown a rectangular tile 10 divided in half to form a first square 12 and a second square 14. The tile 10 is basically in the form of a domino and the exact size is a matter of design considerations since it is the shape of the tile that is important, not the physical size of the tile that is actually used in the game.

FIG. 2*a* illustrates a first set of tile 16 containing a first square 18 and a second square 20. In a similar fashion FIG. 2*b* illustrates a second set of tile 22 identical to tile 16 and containing a first square 24 and a second square 26.

Squares 18, 20, 24 and 26 are separately identifiable in the preferred embodiment by means of color differentiation. Squares 18 and 20 have different colors and squares 24 and 26 have different colors with the only caviat being that square 18 and square 24 have the same color.

Experiments indicate that the three colors chosen should be readily identifiable, and in one embodiment squares 18 and 24 are painted bright yellow whereas square 20 was painted black and square 26 was painted red. In still another embodiment squares 18 and 24 were left white and square 20 was made black and square 26 was painted red.

The object of the game is the player of the first set of tile 16 to attempt to obtain at least four similar colored squares 18 or 20 in a column, a row, or on a diagonal. Similarly a player of the second set of tile 22 will attempt to obtain four similar squares 24 or 26 in column, a row, or on a diagonal. The first player to obtain four touching tiles in either a row, a column or on a diagonal is the winner.

The game is played with each player alternately placing a tile in any position provided only that it touch along an edge, a side or on a corner with tile previously played. It can be quickly appreciated therefore that each player actually has two chances of winning the game, one being based upon the color of squares 18 and also based upon the color of squares 20. Similarly, the player of the second set of tile has an opportunity to win based upon the color of squares 24 and the color of squares 26. Since the players play a tile alternately, there will always be twice as many colors of squares 18 and 24 on the board and, hence, the tactics of playing the common color will differ from the tactics of playing the dedicated color associated with that set of tile.

The game is also capable of being played by blind people who cannot distinguish the different squares based upon color.

Referring now to FIG. 3 there is shown a first set of tile 26 containing a first square 28 having a raised circle 30 located on the square 28. In a similar fashion tile 26 also contains square 32 which contains a raised triangle 34 attached to the square 32. In this fashion a blind person or one not capable of distinguishing colors can immediately feel a triangle and a square and identify the difference between square 28 and square 32.

In a similar fashion FIG. 3*b* illustrates a second set of tile 36 containing a first square 38 having a raised circle 40 thereon and a second square 42 having a raised square 44 located thereon.

It is quite obvious that the actual symbol attached to the individual squares may be varied and need not be limited to the circle 30, the triangle 34 and the square 44 illustrated. These physical indicia were selected because of their universal acceptance and identity and it is certainly appreciated that any other basic shape may be used as an indicia to identify the individual squares.

For purposes of illustration, reference to the individual tile will be made by utilizing the tile illustrated in FIG. 3*a* and 3*b*.

Referring now to FIGS. 4, 5, 6, 7 and 8, there is shown a series of diagrams illustrating how opposing tile may be made to touch one another to form a pattern of at least four squares in either a row, a column or a diagonal.

Referring now to FIG. 4, there is shown tile 26 touching tile 36 along a common long edge. In this configuration, square 28 of tile 26 and square 38 of tile 36 are in abutting touching relationship thereby forming two squares containing common indicia such as the raised circle in a row.

Referring now to FIG. 5, there is shown tile 26 in a touching relationship with tile 36 in which only square 28 of tile 26 is touching square 38 of tile 36. In this fashion squares 28 and 38 which are similar in view of the raised circle 30 and 40, respectively, are said to be touching to form a column of two similar squares.

Referring now to FIG. 7, there is illustrated how square 28 of tile 26 is in a touching relationship with square 38 of tile 36 so as to form two similar squares on a row.

Referring now to FIG. 6, there is shown a diagonal touching relationship where square 38 of tile 36 is touching a corner of square 28 of tile 26 so as to place squares 38 and 28 in a touching relationship and on a diagonal.

Referring now to FIG. 8, there is shown square 28 and tile 26 touching square 42 of tile 36 along a common side so as to place square 38 of tile 36 in a diagonal relationship with square 28 of tile 26. A comparison of FIGS. 6 and 8 will show that common tile may touch on a corner as shown in FIG. 6 and touch on a side as shown in FIG. 8 and still be on a diagonal illustrated in FIGS. 6 and 8.

The game is preferably played on a substantially flat board or table which does not necessarily become part of the game but simply provides a basis for holding the tile in question.

The tile is placed alternately with first a tile from the first set being placed on the table and then a tile from the second set placed in a touching relationship with any other tile previously placed on the table.

Referring now to FIGS. 9, 10, 11, 12 and 13, there is shown a sample game showing how a preferred column of at least four tiles is obtained either on a row, a column or on a diagonal according to the teachings of the present invention.

FIG. 9 illustrates tile 36 containing square 38 and square 42 placed on the table.

FIG. 10 illustrates the placing of the tile 26 in such a relationship that square 28 is caused to touch square 42 of tile 36. In this relationship squares 38 and 28 are in a touching relationship and form a diagonal of two similar squares. Either of the players may take advantage of the common squares containing the raised circle 40 in an attempt to first obtain four similar squares in a row, a column or a diagonal to thereby win the game.

Alternatively, the player of the first set of tiles can also win by obtaining four similar squares containing the raised square 44 in either a column, a row or a diagonal. Similarly, the player of tile 26 may win by first obtaining four similar squares in either a row, a column or a diagonal containing the raised triangle 34.

Referring now to FIG. 11, there is shown 36 prime being placed in position where square 38 prime is caused to touch square 42 on a corner, thereby creating a diagonal of two common squares, 42 and 38 prime, containing the same indicia which in this case is the raised square 44.

Referring now to FIG. 12, there is shown the alternate location of tile 26 prime being placed in position whereby the square 32 prime is in a touching relationship with square 28 of tile 26. In this position square 28 prime is in a diagonal relationship with square 28 since both square 28 and square 28 prime each contain similar indicia.

A review of FIG. 12 will also show a diagonal relationship of square 32 prime on tile 26 prime and square 32 on tile 26.

A review of the tactics of the game will show that whenever a player obtains two dedicated indicia in either a row, a column, or a diagonal, that the other player must guard against and stop any further growth of this pattern since on the very next play the player will then obtain three which cannot be stopped in his ultimate game of getting four.

A review of FIG. 12 will also show that the player of tile 26 should have stopped and attempted to block two diagonal squares 42 of tile 36 and 42 prime of tile 36 prime since squares 22 and 42 prime are in a touching relationship and contain two similar squares on a diagonal.

A review of FIG. 13 will show that the player of tile 36 was able to win the game by still another strategic move which was to place tile 36 double prime in position whereby square 38 double prime was placed in a touching relationship with square 28 of tile 26 and square 38 prime of tile 36 prime. This action in locating tile 36 double prime created a row of four tiles on a diagonal comprising square 28 prime of tile 26 prime, square 28 of tile 26, square 38 double prime of tile 36 double prime, and square 38 prime of tile 36 prime.

FIG. 13 illustrates how either party may win by utilizing the common square to obtain four in a row, in a column, or on a diagonal.

By way of review, it can now be appreciated that in FIG. 12 tile 26 prime should not have been placed in the position indicated but, rather, should have been placed so as to stop and block the diagonal of two similar squares 42 and 42 prime located on tiles 36 and 36 prime respectively.

Referring now to FIG. 14, there is shown a preferred position for tile 26 prime which is located so that square 28 prime is in a touching relationship with square 38 of tile 36 and square 28 of tile 26.

In this position tile 26 prime blocks the diagonal excursion of square 42 of tile 36 and square 42 prime of tile 36 prime.

The game will of course continue until either player is capable of obtaining four tiles in a row, in a column or on a diagonal.

The game has been described in connection with obtaining four similar squares in a row, however, the game may be played with five in a row utilizing the same strategy in solving the same problems as described herein.

While the game has been illustrated and described in connection with raised indicia, it is also capable of being played only with three different colors, and in which white is defined as a color.

The game may also be offered solely for use by blind persons by utilizing the raised indicia of the square, the circle and the triangle as illustrated. In this mode it is also suggested that a non-slip base portion be applied to the reverse side of the tile to prevent slipping so that the tiles are not easily moved as in the case of accidental bumping or touching of the tiles.

It is also envisioned the game may be improved for the blind person by utilizing a table or board having indents to accept the shape of the individual tile and thereby prevent the tile from being moved once located on the table and thereby allowing the blind person to touch the tile without fear of moving the tile and upsetting the game due to carelessness resulting from his lack of sight.

The skill of the game is the same for both the blind person and the person who can see and the ability to first obtain four tiles in a row, in a column or on diagonal remains a game of skill for all players.

I claim:

1. A game for establishing a pattern of identical squares in either a rank, a file or a diagonal comprising:

a first set comprising a plurality of identical three dimensional rectangles each divided into identical first squares and identical second squares, said first and second squares on said first set of rectangles being separately identifiable from each other, a second set comprising a plurality of identical three dimensional rectangles each divided into identical first squares and identical second squares, said first and second square on said second set of rectangles being separately identifiable from each other, said first square on each rectangle of said first set being identical to said first square on each rectangle of said second set, and said second square on each rectangle of said first set being different from said second square on each rectangle of said second set for establishing a total of three different identifiable squares, whereby alternately placing rectangles from said first set and said second set in a touching relationship provides a contest for first establishing a pattern of identical squares in either rank, a file or a diagonal.

2. A game according to claim 1 in which said first set of rectangles and said second set of rectangles are each in the form of a domino.

3. A game according to claim 2 in which each domino has identifiable indicia on the obverse side only.

4. A game according to claim 1 in which said first and second square on said first set of rectangles and said first and second square on said second set of rectangles each contain identifiable indicia on the obverse side only.

5. A game according to claim 4 in which said identifiable indicia is subject to identification by touch.

6. A game according to claim 5 in which said identifiable indicia consists of a raised circle, a raised square, and a raised triangle.

7. A game according to claim 6 which includes:

said raised circle is located on the obverse side of said first square on each rectangle in said first set and on said first square on each rectangle of said second set, said raised square is located on the obverse side of said second square on each rectangle of said first set, and said raised triangle is located on the obverse side of said second square on each rectangle of said second set.

8. A game according to claim 1 in which each of said squares is visibly identifiable by color.

9. A game according to claim 8 which includes three different colors, a first color located on the obverse side of said first square on each rectangle of said first set and on said first square on each rectangle of said second set, a second color located on the obverse side of said second square on each rectangle of said first set, and a third color located on the obverse side of said second square on each rectangle of said second set.

* * * * *